US006352409B1

(12) United States Patent
Blateri et al.

(10) Patent No.: US 6,352,409 B1
(45) Date of Patent: Mar. 5, 2002

(54) CEILING FAN ASSEMBLY AND METHOD FOR ASSEMBLING SAME

(75) Inventors: Frank Blateri, Coppell, TX (US); Wang Liang Chou, Taichung (TW)

(73) Assignee: Aloha Housewares Co., Ltd., Taichung Hsiang (TW)

( * ) Notice: Subject to any disclaimer, the term of this patent is extended or adjusted under 35 U.S.C. 154(b) by 0 days.

(21) Appl. No.: 09/396,622

(22) Filed: Sep. 15, 1999

(51) Int. Cl.[7] ..... F01D 5/30

(52) U.S. Cl. ..... 416/207; 416/210 R; 416/214 R; 416/220 R

(58) Field of Search ..... 416/5, 204 R, 416/205, 206, 207, 210 R, 214 R, 220 R, 221; 403/322.4, 374.5, DIG. 12

(56) References Cited

U.S. PATENT DOCUMENTS

| | | | | | |
|---|---|---|---|---|---|
| 4,746,271 | A | | 5/1988 | Wright | 416/132 |
| 4,850,799 | A | | 7/1989 | Bucher, Sr. et al. | 416/134 |
| 5,180,284 | A | * | 1/1993 | Monrose, III et al. | 416/204 R |
| 5,302,083 | A | | 4/1994 | Bucher et al. | 416/5 |
| 5,304,037 | A | | 4/1994 | Scofield | 416/134 |
| D347,056 | S | | 5/1994 | Bucher et al. | D23/411 |
| D360,942 | S | | 8/1995 | Bucher et al. | D23/411 |
| 5,458,463 | A | | 10/1995 | Chiang | 416/210 |
| 5,486,094 | A | | 1/1996 | Davis, Jr. et al. | 416/210 |
| 5,542,819 | A | | 8/1996 | Bucher et al. | 416/146 |
| D376,641 | S | | 12/1996 | Bucher | D23/379 |
| 5,944,486 | A | * | 8/1999 | Hodgkins, Jr. | 416/210 R |
| 5,947,356 | A | * | 9/1999 | Delong | 224/404 |
| 6,004,064 | A | * | 12/1999 | Franz | 403/322.4 |
| 6,010,306 | A | * | 1/2000 | Bucher et al. | 416/210 R |
| 6,059,531 | A | * | 5/2000 | Tai | 416/220 A |

* cited by examiner

*Primary Examiner*—Edward K. Look
*Assistant Examiner*—James M McAleenan
(74) *Attorney, Agent, or Firm*—Haynes and Boone, LLP

(57) ABSTRACT

A fan blade assembly and method according to which a mounting arm is provided and at least one clamping member extends from the arm. A blade has a portion engaging the arm, and a through opening for receiving the clamping member. The clamping member is movable to a clamping position to clamp the blade to the arm.

9 Claims, 2 Drawing Sheets

CEILING FAN ASSEMBLY AND METHOD FOR ASSEMBLING SAME

BACKGROUND OF THE INVENTION

The present invention relates to a ceiling fan assembly and a method for assembling same, and, more particularly, to such an assembly and method in which the fan blades can be attached to mounting arms for the fan motor relatively easily and quickly using a minimum number of parts.

Rotating fans that are mounted to the ceilings of homes and businesses are very popular. These types of fans consist of an electric motor mounted to the ceiling and a plurality of angularly-spaced blades. Each blade is mounted to a corresponding mounting arm and the arms are mounted to the casing of the motor. Rotation of the motor casing causes corresponding rotation of the arms, and therefore the blades.

However, it is difficult and time-consuming to mount the blades to the arms since a relatively large number of fasteners, or the like, are normally used to attach each blade to its corresponding arm. Since there are usually five blades and arms, the labor costs involved in assembling and mounting the complete fan assembly constitute a high percentage of the overall cost of the assembly. This difficulty in assembly is compounded when the blades have to be mounted to arms that are already attached to the motor casing mounted to the ceiling since it is difficult to make the connections between the blades and their arms in an elevated position.

Therefore, what is needed is a fan assembly and a method of assembling same in which the fan blades can be easily and quickly attached to the arms, and the arms can be easily and quickly attached to the rotor end casing of the fan motor, without the use of numerous fasteners, or the like, and even when the end casing is mounted to the ceiling.

SUMMARY OF THE INVENTION

An embodiment of the present invention, accordingly, is directed to a ceiling fan assembly and method for assembling same according to which a mounting arm is provided and at least one clamping member extends from the arm. A blade has a portion engaging the arm and a through opening for receiving the clamping member. The clamping member is movable to and from a clamping position to clamp the blade to the arm.

Several advantages result from this arrangement. For example, the use of a multitude of fasteners, such as nuts, bolts and screws, to connect each blade to its corresponding arm are eliminated. Thus, the fan assembly can be assembled and mounted relatively easily and quickly thus reducing labor costs.

DESCRIPTION OF THE PREFERRED EMBODIMENT

Figure 1:
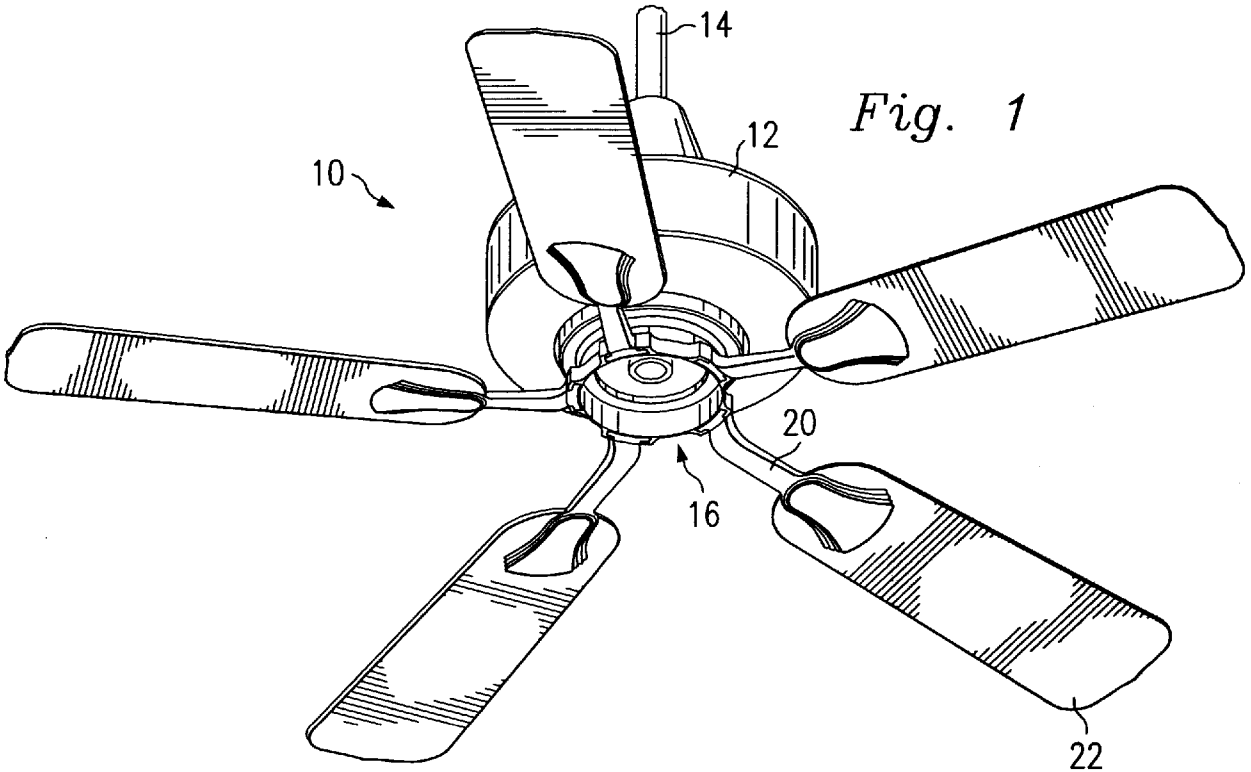
FIG. 1 is an isometric view of the fan assembly of an embodiment of the present invention.

FIG. 1 of the drawings depicts the fan assembly of an embodiment of the present invention which assembly is referred to, in general, by the reference numeral 10 and which includes a housing 12 connected to a ceiling of a building by a mounting rod 14. It is understood that the mounting rod 14 is connected to the ceiling in any known manner, and that electrical conductors extend from an electrical box (not shown) mounted to the ceiling, through the rod, and into the interior of the housing 12. A conventional electrical motor is provided in the housing 12 that includes a stator (not shown) and a rotor that includes an end casing 16 that protrudes downwardly, as viewed in FIG. 1, through an opening in the lower surface of the housing.

Five mounting arms, one of which is shown by the reference numeral 20, are mounted to the end casing 16. This mounting can be in any conventional manner, or in the manners disclosed in patent applications Ser. Nos. 097,623, 196,798, 243,253, or 334,976. These applications are assigned to the assignee of the present invention and their respective disclosures are incorporated by reference.

Five elongated blades, one of which is shown by the reference numeral 22, are respectively mounted to the arms, including the arm 20. The manner in which the blades 22 are attached to the arms 20 will be described in detail.

Figure 2:
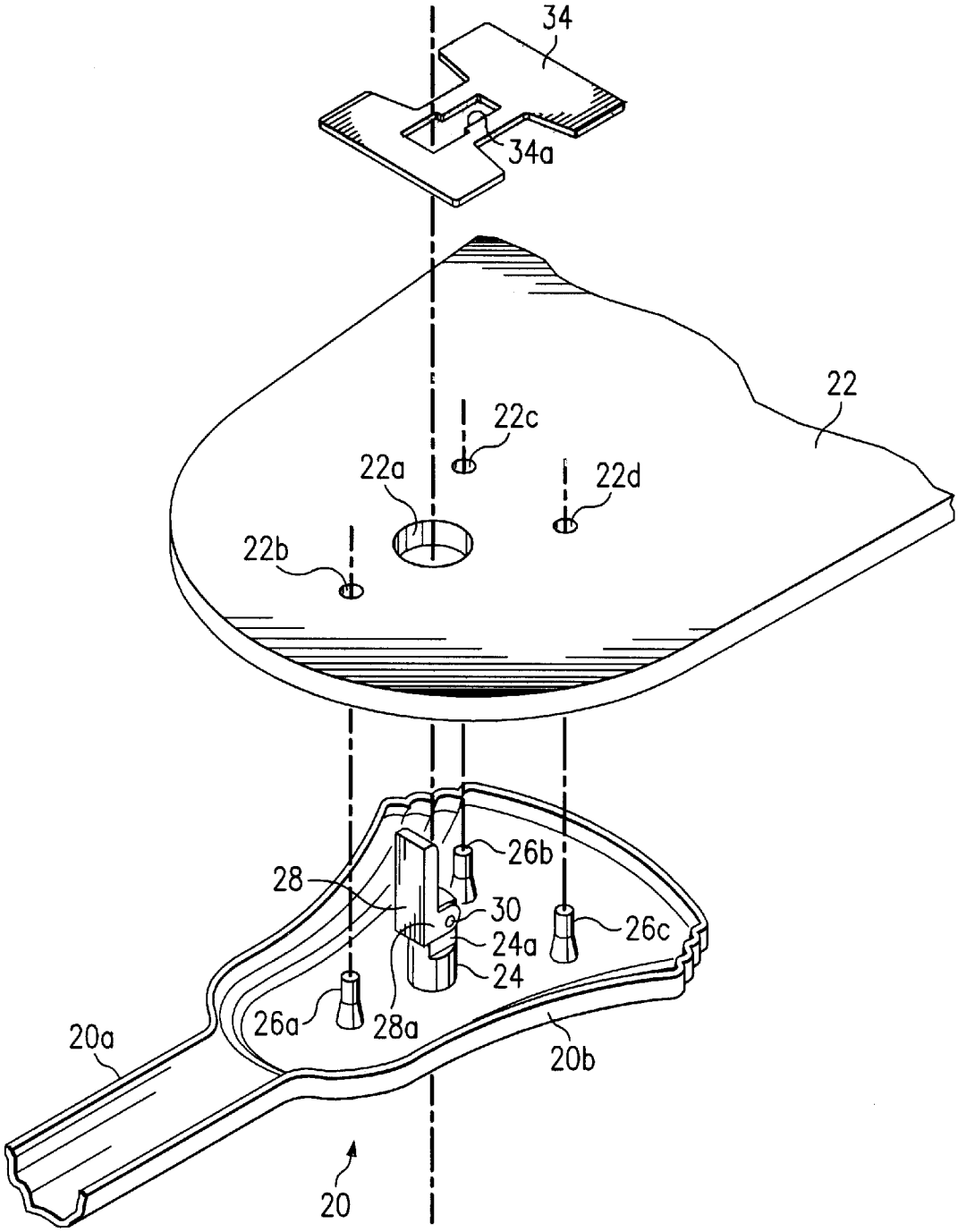
FIG. 2 is an enlarged, partial, exploded, isometric view depicting the mounting of a fan blade of the assembly of FIG. 1 to its corresponding arm.

Referring to FIG. 2, the arm 20 includes an intermediate portion 20*a* that extends between a relatively wide blade-receiving portion 20*b* and a mounting flange (FIG. 1) that connects to the end casing 16 in any conventional manner or in the manners disclosed in the above applications. The blade-receiving portion 20*b* is tapered in shape and is formed integrally with the intermediate portion 20*a*.

A post 24 and three guide pins 26*a*, 26*b*, and 26*c* all extend from the upper surface of the arm portion 20*b* and are preferably formed integrally therewith. The post 24 has two parallel grooves 24*a*, one of which is shown, formed in diametrically opposite walls thereof for reasons to be explained.

A clamping member 28 is pivotally mounted to the upper end portion of the post 24. To this end, a shaft 30 extends through a bore formed through the post 24 and each end of the shaft protrudes from the corresponding outer surfaces of the post. Two flanges 28*a*, one of which is shown, extend from the lower portions of the respective side walls of the clamping member 28 and each flange has a through opening for receiving the corresponding end portion of the shaft 30.

The lower surface of an end portion of the blade 22 extends over the upper surface of the arm portion 20*b* as viewed in FIG. 2. Three openings 22*b*,22*c*, and 22*d* are formed though the latter blade portion for receiving the guide pins 26*a*, 26*b*, and 26*c*, respectively. Also, an enlarged opening 22*a* extends through the latter portion of the blade 22 for receiving the post 24 and the clamping member 28, with a portion of the post 24, including the grooves 24*a*, extending above the upper surface of the blade.

A locking plate 34 extends over the upper surface of the blade 22 and has a through opening 34*a* through which the clamping member 28 and the post 24 extend. The opening 34*a* has a relatively wide portion and a relatively narrow portion having a width substantially corresponding to the width of that portion of the post 24 in which the grooves 24*a* are formed, for reasons to be described.

Figure 3:
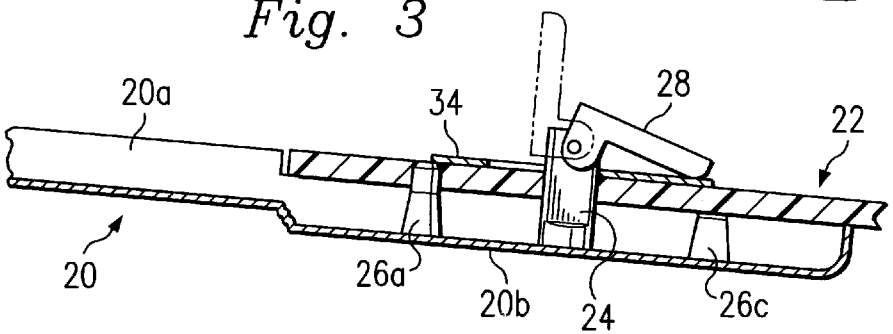
FIG. 3 is a partial sectional view of the blade and arm of FIG. 2 shown in an assembled condition.

To mount the blade 22 on the upper surface of the arm 20 the blade is lowered from its position of FIG. 2 with the openings 22*b*, 22*c*, and 22*d* aligned with their corresponding guide pins 26*a*, 26*b*, and 26*c*, and with the clamping member 28 in alignment with the blade opening 22*a*. When the lower surface of the blade 22 engages the upper surface of the arm 20, the locking plate 34 is placed over the upper surface of the blade with the clamping member 28 and the post 24 extending through the relatively wide portion of its opening 34*a*. The plate 34 is then slid in a direction towards the end of the blade 22 shown in FIG. 2 until the relatively narrow portion of its opening 34*a* extends in the grooves 24*a* of the post 24 which locks the blade to the arm 20, as shown in FIG. 3. The clamping member 28 is then pivoted from its upright position of FIG. 2, shown by the phantom lines in FIG. 3, to a horizontal, clamping position shown by the solid lines in FIG. 3. The design is such that during this pivotal movement of the clamping member 28, the ends of the flanges 28*a* engage the plate 34 and exert a downwardly directed force against the plate, and therefore the blade 22, to clamp the plate to the blade, and the blade to the arm 20.

It is understood that the other four blades are connected to their respective arms in the same manner.

As a result of the foregoing, each blade 22 can be connected to the arms 20 using no fasteners and only the plate 34 and clamping member 28. Thus, the use of a large number of nuts, bolts and screws is eliminated. Since, the arms 20 can be easily and quickly be connected to the end casing 16 in the manner disclosed in the above applications, the entire fan assembly 10 can be installed relatively easily and quickly thus considerably reducing the labor costs.

It is understood that variations may be made in the foregoing without departing from the scope of the invention. For example, the number of arms 20, blades 22, and guide pins 26 can be varied within the scope of the invention. Further, the spatial references, such as "upper", "lower", "downwardly", etc., are for the purpose of illustration only and do not limit the spacial orientation or location of the structure described.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fan blade assembly comprising a mounting arm; at least one guide pin extending from the arm; a post extending from the arm and having at least one groove formed therein; a clamping member pivotally mounted to the post; a blade having a portion engaging a portion of the arm and a plurality of through openings for receiving the guide pin and the post, the clamping member being pivotal to and from a clamping position in which it clamps the blade to the arm; and a locking plate adapted to rest on a surface of the blade and extend in the groove to lock the blade to the arm.

2. The assembly of claim 1 wherein the locking plate has a relatively large opening for receiving the post and a relatively small opening, the plate being adapted for slidable movement relative to the blade so that the portion of the plate defining the relatively small opening extends in the groove.

3. The assembly of claim 2 wherein there are two grooves formed on diametrically opposite sides of the post, and wherein the relatively small opening in the locking plate is rectangular with the opposed portions of the plate defining the relatively small opening respectively extending in the grooves.

4. A fan assembly comprising an electric motor having an end casing; a mounting arm extending from the end casing; at least one guide pin extending from the arm; a post extending from the arm and having at least one groove formed therein; a clamping member pivotally mounted to the post; a blade having a portion engaging a portion of the arm and a plurality of through openings for receiving the guide pin and the post, the clamping member being pivotal to and from a clamping position in which it clamps the blade to the arm; and a locking plate adapted to rest on a surface of the blade and extend in the groove to lock the blade to the arm.

5. The assembly of claim 4 wherein the locking plate has a relatively large opening for receiving the post and a relatively small opening, the plate being adapted for slidable movement relative to the blade so that the portion of the plate defining the relatively small opening extends in the groove.

6. The assembly of claim 5 wherein there are two grooves formed on diametrically opposite sides of the post, and wherein the relatively small opening in the locking plate is rectangular with the opposed portions of the plate defining the relatively small opening respectively extending in the grooves.

7. A method of assembling a fan blade assembly comprising providing a plurality of guide pins and a post extending from a mounting arm; forming at least one groove in the arm; pivotally mounting a clamping member to the post; engaging a portion a blade with a portion of the arm, with the guide pin and the post extending through corresponding openings in the blade; pivoting the clamping member to and from a clamping position in which it clamps the blade to the arm; and providing a locking plate on a surface of the blade; and sliding the plate into the groove to lock the blade to the arm.

8. The method of claim 7 further comprising providing a relatively large opening in the plate for receiving the post and a relatively small opening in the plate, the step of sliding being such that the portion of the plate defining the relatively small opening extends in the groove.

9. The method of claim 8 wherein the step of forming comprises forming two grooves formed on diametrically opposite sides of the post, so that, as a result of the step of sliding, the opposed portions of the plate defining the relatively small opening respectively extending in the grooves.

* * * * *